US007328940B2

(12) United States Patent
Zheng

(10) Patent No.: US 7,328,940 B2
(45) Date of Patent: Feb. 12, 2008

(54) COLLAPSIBLE QUAD CHAIR WITH INTEGRATED BACK AND ARMREST

(75) Inventor: Edward Zheng, Chino Hills, CA (US)

(73) Assignee: Tofasco of America, Inc., Laverne, CA (US)

( * ) Notice: Subject to any disclaimer, the term of this patent is extended or adjusted under 35 U.S.C. 154(b) by 70 days.

(21) Appl. No.: 11/364,524

(22) Filed: Feb. 27, 2006

(65) Prior Publication Data

US 2007/0200395 A1 Aug. 30, 2007

(51) Int. Cl.
*A47C 4/00* (2006.01)

(52) U.S. Cl. ..... 297/44; 297/16.2; 297/45

(58) Field of Classification Search ..... 297/42, 297/44, 45, 16.2
See application file for complete search history.

(56) References Cited

U.S. PATENT DOCUMENTS 2,691,410 A * 10/1954 Boucher ..... 297/45
3,124,387 A 3/1964 Maclaren
4,652,047 A 3/1987 Chan
4,685,725 A 8/1987 Helfrich
4,836,601 A 6/1989 Cone
5,499,857 A 3/1996 Lynch, Jr.
5,718,473 A 2/1998 Lynch, Jr.
5,984,406 A * 11/1999 Lee ..... 297/16.2

FOREIGN PATENT DOCUMENTS

FR 2532535 3/1984

* cited by examiner

*Primary Examiner*—Anthony D. Barfield
(74) *Attorney, Agent, or Firm*—Fish & Associates, PC

(57) ABSTRACT

Particularly preferred collapsible chairs have a minimum configuration in which the back and front rods in a quad arrangement are extended to support the arm rests, the backrest, and the seat, and wherein the back and front rods are angled such that the backrest width to seat height has a ratio of between 1.4 to 1.8. Such chairs are not only esthetically pleasing, but also relatively comfortable for users of average and above-average height.

18 Claims, 1 Drawing Sheet

COLLAPSIBLE QUAD CHAIR WITH INTEGRATED BACK AND ARMREST

FIELD OF THE INVENTION

The field of the invention is collapsible chairs.

BACKGROUND OF THE INVENTION

Numerous collapsible chairs are known in the art, and many of those include a plurality of X-shaped braces that cooperate together to form a collapsible brace. Examples for such chairs are found in FR 2,532,535, and U.S. Pat. No. 3,124,387, U.S. Pat. No. 5,718,473, U.S. Pat. No. 5,499,857, U.S. Pat. No. 4,836,601, U.S. Pat. No. 4,685,725, or U.S. Pat. No. 4,652,047. While such chairs provide collapsibility, various disadvantages remain. Among other things, some of the known chairs require disassembly for folding, removal of one or more components before folding, or by virtue of their arrangement, a relatively low seat height. Moreover, not all of such chairs are comfortable over a prolonged period of time, especially for a relatively tall person. Thus, while there are numerous collapsible chairs known in the art, various problems remain with such chairs. Consequently, there is still a need to provide improved collapsible chairs.

SUMMARY OF THE INVENTION

The present invention is directed to a collapsible chair that has (a) a front brace having a first and a second front rod rotatably coupled to each other, (b) a left side brace having a first and a second left side rod rotatably coupled to each other, (c) a right side brace having a first and a second right side rod rotatably coupled to each other, (d) a back brace having a first and a second back rod rotatably coupled to each other, wherein the front brace, the left side brace, the right side brace, and the back brace are coupled to each other to form a collapsible frame. In especially contemplated chairs, a seat is slidably coupled to the front brace and the back brace, and the seat is further contiguous with a back rest that is coupled to the back brace.

Most typically, an armrest is coupled to the front brace and the back brace, and the first and second rods of the back brace are angled to a degree such that the chair has a seat height of at least about 17 inches at a maximum backrest width of about 30 inches. Viewed from a different perspective, the first and second rods of the back brace are angled to a degree such that the chair has a backrest width to seat height ratio of between 1.4 to 1.8.

While not limiting to the inventive subject matter, the collapsible chair has a maximum backrest height of about 30 inches, and the first and second rods of front brace are angled to a degree such that the armrests have a maximum distance from each other of about 20 inches. Moreover, it is generally preferred that the armrest is coupled to the angled portion of the first and second rods of front brace, and/or that the armrest is slidably coupled to a rod of the back brace. A stopper is preferably coupled to the first and second rods of the front and back brace, respectively, at a position effective to maintain the seat height at a height of at least about 17 inches, and/or the upper portion of the backrest is fixedly coupled to the ends of the first and second rods of the back brace, while the lower portion of the back rest is slidably coupled to the first and second rods of the back brace. In such chairs, it is generally preferred that the backrest is coupled to the angled portion of the first and second rods of the back brace.

Particularly preferred backrest width to seat height ratios are between 1.4 and 1.6 and between 1.6 and 1.8, and the seat height is at least 16 inches. Alternatively, or additionally, it is preferred that the backrest width is less than 30 inches, and more typically less than 28 inches. In still further preferred chairs, the first and second rods of the front brace are angled such that the arm rest distance is less than 22 inches, and more typically less than 20 inches.

Various objects, features, aspects and advantages of the present invention will become more apparent from the following detailed description of preferred embodiments of the invention.

DETAILED DESCRIPTION

Figure 1:
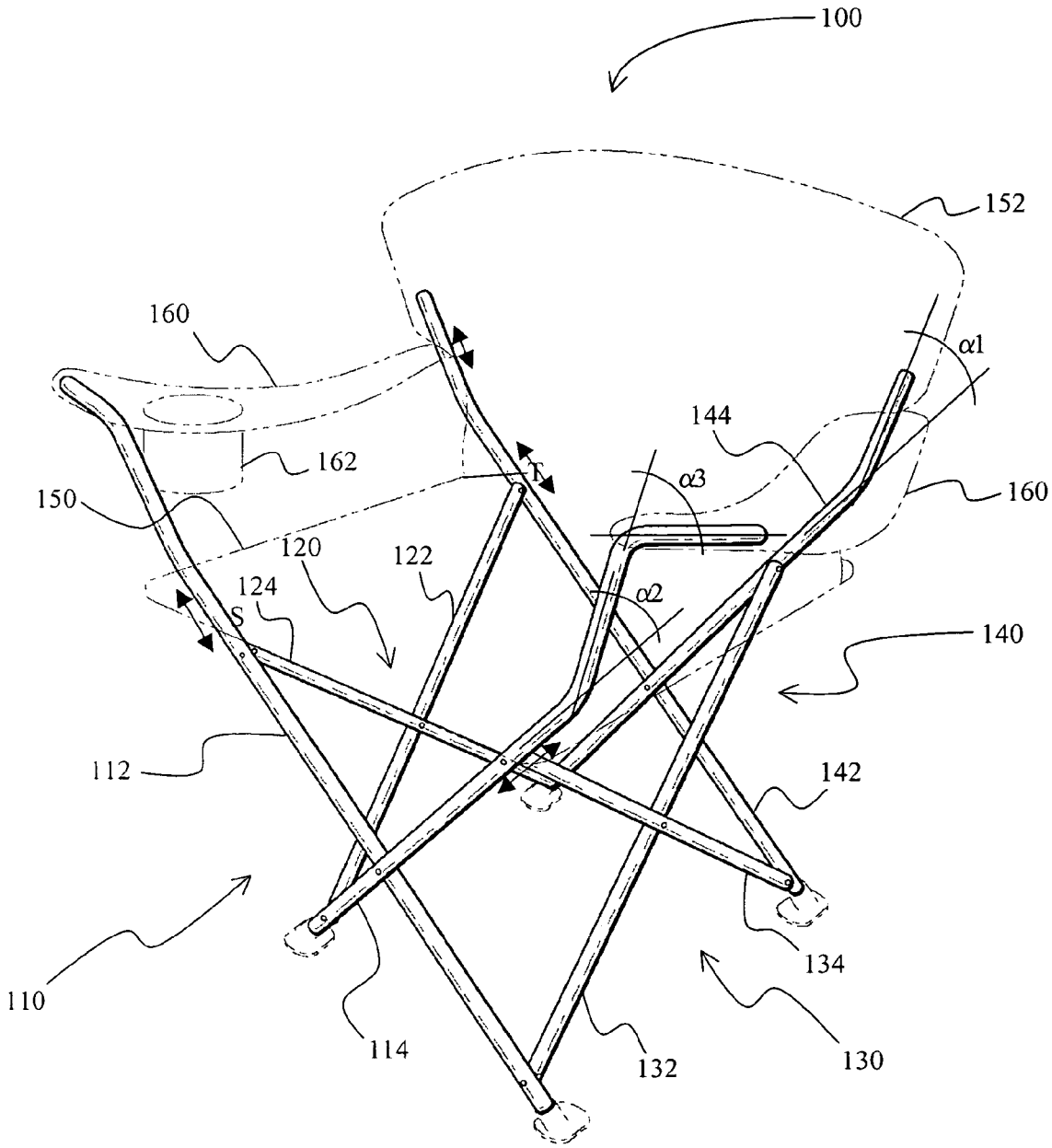
FIG. 1 is a perspective view of a collapsible chair according to the inventive subject matter.

The inventors have discovered that a collapsible chair can be manufactured from a frame that has a quad configuration to which the seat, the armrests and the back are coupled without use of backrest support rods and/or armrest support rods.

In one especially preferred aspect of the inventive subject matter as depicted in FIG. 1, a collapsible chair 100 has a front brace 110 having a first and a second front rod 112 and 114, respectively, rotatably coupled to each other. A left side brace 120 has a first and a second left side rod 122 and 124, respectively, rotatably coupled to each other. A right side brace 130 has a first and a second right side rod 132 and 134, respectively, rotatably coupled to each other, and a back brace 140 has a first and a second back rod 142 and 144, respectively, rotatably coupled to each other. In such chairs, it is especially preferred that the front brace, the left side brace, the right side brace, and the back brace are movably coupled (typically via the ends of the rods in the side braces) to each other to form a collapsible quad frame. The seat 150 is slidably coupled to the front brace 110 (e.g., via an opening in the seat; not shown) and the back brace 140 (e.g., via a tab T with an opening that is coupled to the seat and back). The seat is further contiguous with the back rest 152 that is coupled to the back brace 140. The armrests 160 (optionally with cup holder 162) are coupled to the front brace 110 and (preferably slidable via opening) to the back brace 140.

It is especially preferred that the upper ends of the first and second rods of the back brace 140 are angled to a degree such that the chair has a seat height of at least about 17 inches at a maximum backrest width of about 30 inches. Most typically, for a chair for an adult person, the angle $\alpha 1$ will be between about 10 and 35 degrees. To accommodate the armrests in a position that is particularly comfortable to a person sitting in the chair, it is also preferred that the upper ends of the front rods are angled at an angle $\alpha 2$, typically between about 15 and 45 degrees. While not limiting to the inventive subject matter, it is generally preferred that $\alpha 1$ and $\alpha 2$ are identical. Moreover, another angled portion may be included in the front rods that will receive part of the armrest 160 (typically in a horizontal position), wherein the that angle $\alpha 3$ will be between about 40 and 100 degrees. It should further be noted that the angles are preferably positioned at a height above the seat to allow for maximum seat width at minimum backrest width. The term "about" as used herein in conjunction with a numeral refers to a range of +/−10% of that numeral, inclusive. For example, the term "about 15" inches refers to any numeral between 13.5 inches to 16.5 inches, inclusive.

It should especially be appreciated that using such angled rods, collapsible chairs can be manufactured without a separate backrest support rod as commonly found in many other known collapsible chairs. Indeed, quad chairs without a separate backrest support rod and without the angled back (and front) rods would either be excessively wide to achieve an acceptable seat height, or have an unacceptably low and/or narrow seat at an acceptable backrest width. Thus, using angled rods for the back brace (and front brace) will advantageously allow construction of a chair having a backrest width to seat height ratio of between 1.4 to 1.8.

Most typically, contemplated seat heights (as measured from the front edge of the unfolded seat to the ground on which the chair stands) will be between about 10 inches (e.g., for kid's chairs) to about 24 inches (e.g., for a barstool type seat), or even higher. However, it is generally preferred that the seat height will be between about 16-17 inches, 17-18 inches, or 18-19 inches (in certain embodiments, it may be preferred that the seat height is at least 16 inches). Similarly, the seat width may vary considerably and will typically be between about 15 inches to about 28 inches. However, more preferably, the seat width will be between about 18 and 20 inches, or between 20 and 22 inches, or between 22 and 24 inches. With respect to the back rest width, it is generally preferred that suitable widths may be between 20 and 35 inches, and more preferably between about 24 to 26 inches, between 26 and 28 inches, or between 28 and 30 inches. In some aspects of the inventive subject matter, the maximum backrest width is less than 30 inches, and even more preferably less than 28 inches, while preferred backrest heights will not exceed about 30 inches. Consequently, and among other ratios, particularly preferred backrest width to seat height ratios are between about 1.4 and 1.6, or between about 1.6 and 1.8.

It is still further preferred that the first and second rods of the front brace are angled to a degree such that the armrests have a distance from each other of between about 16 inches to about 25 inches (with the distance being measured between the armrest edges facing each other when the chair is in the unfolded configuration). However, in especially preferred aspects of the inventive subject matter, the angle $\alpha 2$ will be such as to provide a maximum armrest distance of about 18-20 inches, or 20 to 22 inches. Furthermore, and in most typical embodiments, the first and second rods of the front brace are angled such that the arm rest distance is less than 22 inches, and more preferably less than 20 inches. Where implemented, it is preferred that angle $\alpha 3$ will be selected to provide a horizontal support for the armrest. Most preferably, the angles and rod positions are also selected such that the maximum width of the backrest is equal or less than the maximum width of the chair, and most typically equal or less than the distance of the outer edges or the armrests of the chair.

With respect to the seat it is generally preferred that the seat is made from a material that sufficiently flexible to allow folding of the seat. Therefore, numerous materials are deemed suitable and exemplary materials include natural and synthetic fibers, which are typically woven into a cloth or other generally sheet-like form. The seat preferably has a rectangular shape (as observed from the top of the chair) and is dimensioned such that the width is substantially wider than the depth as measured from the front to the back. For example, a typical chair according to the inventive subject matter will have a width of between about 18 to 25 inches, while having a depth of between about 12 to 18 inches.

Similarly, it is generally contemplated that the back rest and arm rests are fabricated from the same material as the seat. Most typically (but not necessarily so), the seat and the backrest are contiguous and coupled to the front and back rods. In especially preferred aspects, the upper portion of the backrest is fixedly coupled to the ends of the first and second rods of the back brace, and the lower portion of the backrest is slidably coupled to the first and second rods of the back brace. Such slidable coupling may be done via a tab that is coupled to the backrest as depicted in FIG. 1 or indirectly, by coupling the backrest to the seat and by coupling the seat slidably to the back rods. There are numerous manners of slidably coupling seats and backrests to rods known in the art, and all of those are contemplated herein. Similarly, all known manners of fixedly coupling the seat, armrest, and/or backrest are known in the art, and all of such manners are deemed suitable for use herein. However, it is generally preferred that the fixed coupling includes an anchor to which the fabric or other material is sewn, wherein that anchor is then affixed to the rod (e.g., by sliding and bolting). Most typically, and using such coupling, the backrest is in substantially vertical (+/−10 degrees) and/or the seat is substantially horizontal (+/−10 degrees) when the chair is in the unfolded configuration.

Thus, it should be recognized that the upper portion of the backrest is preferably fixedly coupled to the angled portion of the first and second rods of the back brace and that the lower portion of the backrest is preferably fixedly coupled to the angled portion of the first and second rods of the back brace. In contrast, both sides (front and back) of the seat are preferably slidably coupled to the angled portion of the first and second rods of the back brace and front brace. To maintain a desired distance of the seat from the ground, it is generally preferred that a stopper (schematically depicted as S in FIG. 1, other stoppers on remaining rods not shown) or other element is coupled to the first and second rods of the front and back brace, respectively, at a position effective to maintain the seat height (e.g., at a height of at least about 17 inches). Such elements may be disks, sleeves, pins, etc, or may be even integral with the rods. In still further contemplated aspects, it is generally preferred that each of the front and back rods has a foot element preferably coupled to the front and back rods. Most typically, such foot elements are fixedly coupled to the front and back rods and are not coupled to the side rods. Therefore, in such configurations the foot elements will not need rotating and/or pivoting points to accommodate for the folding motion.

With respect to the armrest, it is typically preferred that the armrest is on one end coupled to the angled portion of the first and second rods of front brace, and on the other end slidably coupled to a rod of the back brace. Contemplated rods for the braces may be made from numerous materials known in the art and it should be appreciated that all known materials for collapsible chairs are deemed suitable for use herein. However, especially preferred materials include metals, metal alloys, synthetic polymers, and all reasonable combinations thereof. Furthermore, it should be appreciated that the rods are movably coupled to each other such as to allow a collapsing motion in which the frame folds in a side-to-side motion as the frame folds in a front-to-back motion. Thus, movable couplings between the rods may have at least one, and more typically at least two degrees of rotational freedom. However, and where desired, rotating couplings may also be replaced with sliding couplings.

Thus, specific embodiments and applications of collapsible quad chairs with integrated back and armrest have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A collapsible chair with armrests, comprising:

a front brace having a first and a second front rod rotatably coupled to each other;

a left side brace having a first and a second left side rod rotatably coupled to each other;

a right side brace having a first and a second right side rod rotatably coupled to each other;

a back brace having a first and a second back rod rotatably coupled to each other;

wherein the front brace, the left side brace, the right side brace, and the back brace are coupled to each other to form a collapsible frame;

wherein a seat is slidably coupled to the front brace and the back brace such that the seat moves along front and back brace as the chair is collapsed, and wherein the seat is further contiguous with a back rest that is coupled to the back brace;

wherein an armrest is coupled to the front brace and the back brace; and wherein the first and second rods of the back brace have respective first and second portions that form an angle $\alpha 1$ between 10 and 35 degrees are angled to a degree such that the chair has a seat height of at least about 17 inches at a maximum backrest width of about 30 inches.

2. The collapsible chair of claim 1 a maximum backrest height of about 30 inches.

3. The collapsible chair of claim 1 wherein the first and second rods of front brace have respective first and second portions that form an angle $\alpha 2$ between 15 and 45 degrees such that the armrests have a maximum distance from each other of about 20 inches.

4. The collapsible chair of claim 3 wherein the armrest is coupled to the first portion of one of the first and second rods of front brace, wherein the first portion is shorter that the second portion.

5. The collapsible chair of claim 1 wherein the armrest is slidably coupled to a rod of the back brace.

6. The collapsible chair of claim 1 further comprising a stopper coupled to the first and second rods of the front and back brace, respectively, at a position effective to maintain the seat height at a height of at least about 17 inches.

7. The collapsible chair of claim 1 wherein an upper portion of the backrest is fixedly coupled to the ends of the first and second rods of the back brace, and wherein a lower portion of the back rest is slidably coupled to the first and second rods of the back brace.

8. The collapsible chair of claim 1 wherein the backrest is coupled to the first portion of the first and second rods of the back brace wherein the first portion is shorter that the second portion.

9. A collapsible chair with armrests, comprising:

a front brace having a first and a second front rod rotatably coupled to each other;

a left side brace having a first and a second left side rod rotatably coupled to each other;

a right side brace having a first and a second right side rod rotatably coupled to each other;

a back brace having a first and a second back rod rotatably coupled to each other;

wherein the front brace, the left side brace, the right side brace, and the back brace are coupled to each other to form a collapsible frame;

wherein a seat is slidably coupled to the front brace and the back brace such that the seat moves along front and back brace as the chair is collapsed, and wherein the seat is further contiguous with a back rest that is coupled to the back brace;

wherein an armrest is coupled to the front brace and the back brace; and wherein the first and second rods of the back brace have respective first and second portions that form an angle $\alpha 1$ between 10 and 35 degrees such that the chair has a backrest width to seat height ratio of between 1.4 to 1.8.

10. The collapsible chair of claim 9 wherein the ratio is between 1.4 and 1.6.

11. The collapsible chair of claim 9 wherein the ratio is between 1.6 and 1.8.

12. The collapsible chair of claim 9 wherein the seat height is at least 16 inches.

13. The collapsible chair of claim 9 wherein the backrest width less than 30 inches.

14. The collapsible chair of claim 9 wherein the backrest width less than 28 inches.

15. The collapsible chair of claim 9 wherein the first and second rods of the front brace have respective first and second portions that form an angle $\alpha 2$ between 15 and 45 degrees such that the arm rest distance is less than 22 inches.

16. The collapsible chair of claim 9 wherein the first and second rods of the front brace have respective first and second portions that form an angle $\alpha 2$ between 15 and 45 degrees such that the arm rest distance is less than 20 inches.

17. The collapsible chair of claim 9 further comprising a stopper coupled to the first and second rods of the front and back brace, respectively, at a position effective to maintain the seat height at a height of at least about 17 inches.

18. The collapsible chair of claim 9 wherein an upper portion of the backrest is fixedly coupled to the ends of the first and second rods of the back brace, and wherein a lower portion of the back rest is slidably coupled to the first and second rods of the back brace.

* * * * *